US006086461A

United States Patent [19]

Williams et al.

[11] Patent Number: 6,086,461

[45] Date of Patent: Jul. 11, 2000

[54] WOOD STRIP SANDING MACHINE

[75] Inventors: Buddy E. Williams; Terri W. Birkett, both of Stuart, Va.

[73] Assignee: Harris-Tarkett, Inc., Johnson City, Tenn.

[21] Appl. No.: 09/411,660

[22] Filed: Oct. 4, 1999

[51] Int. Cl.[7] ..... B24B 7/00; B24B 9/00

[52] U.S. Cl. ..... 451/65; 144/3.1; 144/371; 451/302

[58] Field of Search ..... 144/3.1, 371, 1.1; 451/296, 303, 299, 64, 65, 28

[56] References Cited

U.S. PATENT DOCUMENTS

| | | |
|---|---|---|
| D. 349,121 | 7/1994 | Holley et al. . |
| 3,007,500 | 11/1961 | Halicki et al. . |
| 4,196,760 | 4/1980 | McDaniel et al. . |
| 4,243,081 | 1/1981 | Pritelli . |
| 4,323,099 | 4/1982 | Bost . |
| 4,497,353 | 2/1985 | Sproat, Jr. . |
| 4,556,094 | 12/1985 | Willocks . |
| 4,643,237 | 2/1987 | Rosa . |
| 4,720,940 | 1/1988 | Green . |
| 4,855,678 | 8/1989 | Kreiskorte . |
| 4,864,775 | 9/1989 | David . |
| 4,932,448 | 6/1990 | Maioli et al. . |
| 4,936,360 | 6/1990 | Wright . |
| 4,945,958 | 8/1990 | Shoda . |
| 5,005,454 | 4/1991 | Fletcher . |
| 5,107,910 | 4/1992 | Sasaki . |
| 5,291,689 | 3/1994 | Hundebol . |
| 5,443,103 | 8/1995 | Kopacz et al. . |
| 5,597,024 | 1/1997 | Bolyard et al. . |
| 5,653,273 | 8/1997 | Bach . |
| 5,700,183 | 12/1997 | Fletcher . |
| 5,702,287 | 12/1997 | Haney . |
| 5,733,180 | 3/1998 | Kilde . |
| 5,865,228 | 2/1999 | Patterson . |

FOREIGN PATENT DOCUMENTS

| | | |
|---|---|---|
| 0409724 A1 | 1/1991 | European Pat. Off. . |
| 4114828 A1 | 11/1992 | Germany . |

*Primary Examiner*—Derrish H. Banks
*Attorney, Agent, or Firm*—Richard C. Litman

[57] ABSTRACT

A multipurpose woodworking machine for processing wood strips such as flooring and molding is comprised of a router unit positioned upstream of a series of sanding units. The router and sanding units are equipped with oscillating heads which allow the heads to follow the contours of the wood strips, thereby preventing trimming and/or sanding errors which may be caused by uneven wood strip surfaces.

8 Claims, 3 Drawing Sheets

WOOD STRIP SANDING MACHINE

BACKGROUND OF THE INVENTION

1. Field of the Invention

The present invention generally relates to woodworking machines. More specifically, the present invention is drawn to a multipurpose woodworking machine which incorporates a sander and router for finishing flooring strips and molding.

2. Description of the Related Art

The preparation and finishing of wood strips, especially flooring and molding, is an old and established segment of the wood flooring industry. In the not to distant past, the sanding and beveling steps performed on the wood strips were done by hand. Obviously, preparation by hand was slow and highly labor intensive. Also a certain level of skill was necessary to obviate loss because of human error. The advent of machines to perform woodworking functions was a boon to the industry.

There are many types of woodworking machines available in the industry today. Examples of machines that perform a sanding function are shown in U.S. Pat. Nos. Des. 349,121 (Holley et al.), U.S. Pat. No. 4,323,099 (Bost), U.S. Pat. No. 4,720,940 (Green), U.S. Pat. No. 4,864,775 (David), U.S. Pat. No. 5,291,689 (Hundebol), U.S. Pat. No. 5,700,183 (Fletcher), U.S. Pat. No. 5,702,287 (Haney), and U.S. Pat. No. 5,733,180 (Kilde).

U.S. Pat. Nos. 4,196,740 (McDaniel et al.), U.S. Pat. No. 4,556,094 (Willocks), U.S. Pat. No. 4,643,237 (Rosa), and U.S. Pat. No. 5,005,454 (Fletcher) disclose woodworking machines adapted for cutting or milling.

A woodworking machine equipped with a router is displayed in U.S. Pat. Nos. 5,107,910 (Sasaki).

Multipurpose woodworking machines are disclosed in U.S. Pat. Nos. 3,007,500 (Halicki et al.), U.S. Pat. No. 4,243,081 (Pritelli), U.S. Pat. No. 4,497,353 (Sproat, Jr.), U.S. Pat. No. 4,932,448 (Maioli et al.), U.S. Pat. No. 4,936,360 (Wright), U.S. Pat. No. 4,945,958 (Shoda), U.S. Pat. No. 5,443,103 (Kopacz et al.), U.S. Pat. No. 5,653,273 (Bach), U.S. Pat. No. 5,865,228 (Patterson); European Patent number 0,409,724 A1, and German Patent number 4,114,828 A1.

U.S. Pat. No. 5,597,024 (Bolyard et al.) discloses a method of making a hardwood floor while U.S. Pat. No. 4,855,678 (Kreiskorte) shows apparatus for determining the contour of a surface.

None of the above inventions and patents, taken either singularly or in combination, is seen to disclose a woodworking machine having unique structure which permits the heads of a router and sander to follow the contours of wood strips as will subsequently be described and claimed in the instant invention.

SUMMARY OF THE INVENTION

The present invention is an innovative, multipurpose woodworking apparatus which includes routers and sanders. The instant apparatus is especially adaptable to finishing flooring strips and molding.

The woodworking elements of the apparatus are positioned in an alignment so that an unfinished wood strip is first automatically fed to be engaged by router heads where a bevel is put on the edge of the flooring strip. From the routers, the strip is directed to be treated by a series of sanding machines. Each sanding machine can be provided with a different grade of sandpaper for the sanding heads.

A unique feature of the present apparatus is the ability of the router heads and sanding heads to move in both horizontal and vertical planes. The ability of the heads to oscillate up and down, side to side, and end to end with the contour of the wood strip allows the strip to be sanded to a uniform thickness while preserving the integrity of the molding specifications, even with the presence of bowed or bent material. In addition, the process prevents gouging and uneven patterns being sanded into the finished wood.

Accordingly, it is a principal object of the invention to provide a multipurpose woodworking apparatus adapted to process wood strips.

It is another object of the invention to provide a multipurpose woodworking apparatus which incorporates routing and sanding machines.

It is a further object of the invention to provide a multipurpose woodworking apparatus having movable router and sander heads.

Still another object of the invention is to provide a multipurpose woodworking apparatus which is efficient and easy to operate.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
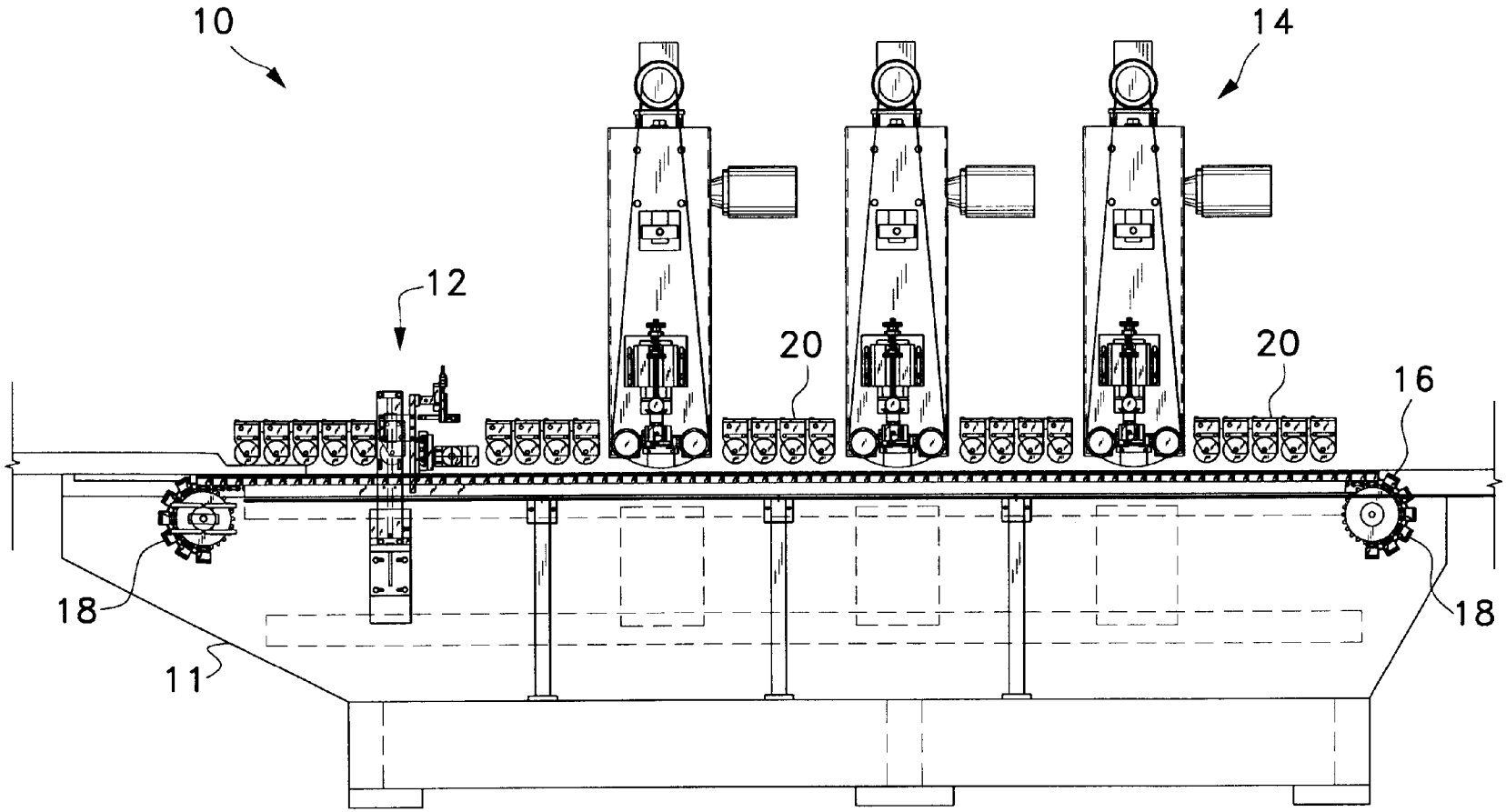
FIG. 1 is a front view of a woodworking machine according to the present invention.

As best illustrated in FIG. 1, the present invention is multipurpose woodworking machine indicated generally at 10 Multipurpose machine 10 is uniquely adapted to perform routing and sanding procedures on elongated wood strips such as flooring or molding. To accomplish the aforestated procedures, machine 10 incorporates a router unit 12 and a plurality of identical sanding units 14. Router unit 12 and sanding units 14 are serially positioned above an endless conveyor belt 16. Router unit 12 and conveyor belt 16 are mounted on a frame 11. The motive power for operating conveyor belt 16 is provided by a motor (not shown) via sprockets 18. Spring loaded roller hold down devices 20 are positioned above belt 16 for applying minimum pressure to the wood strips to maintain alignment as the strips are conveyed along belt 16, through router unit 12, and under sanding units 14. The belt 16 and hold down devices 20 are conventional and are not, per se, part of the inventive concept.

Figure 2:
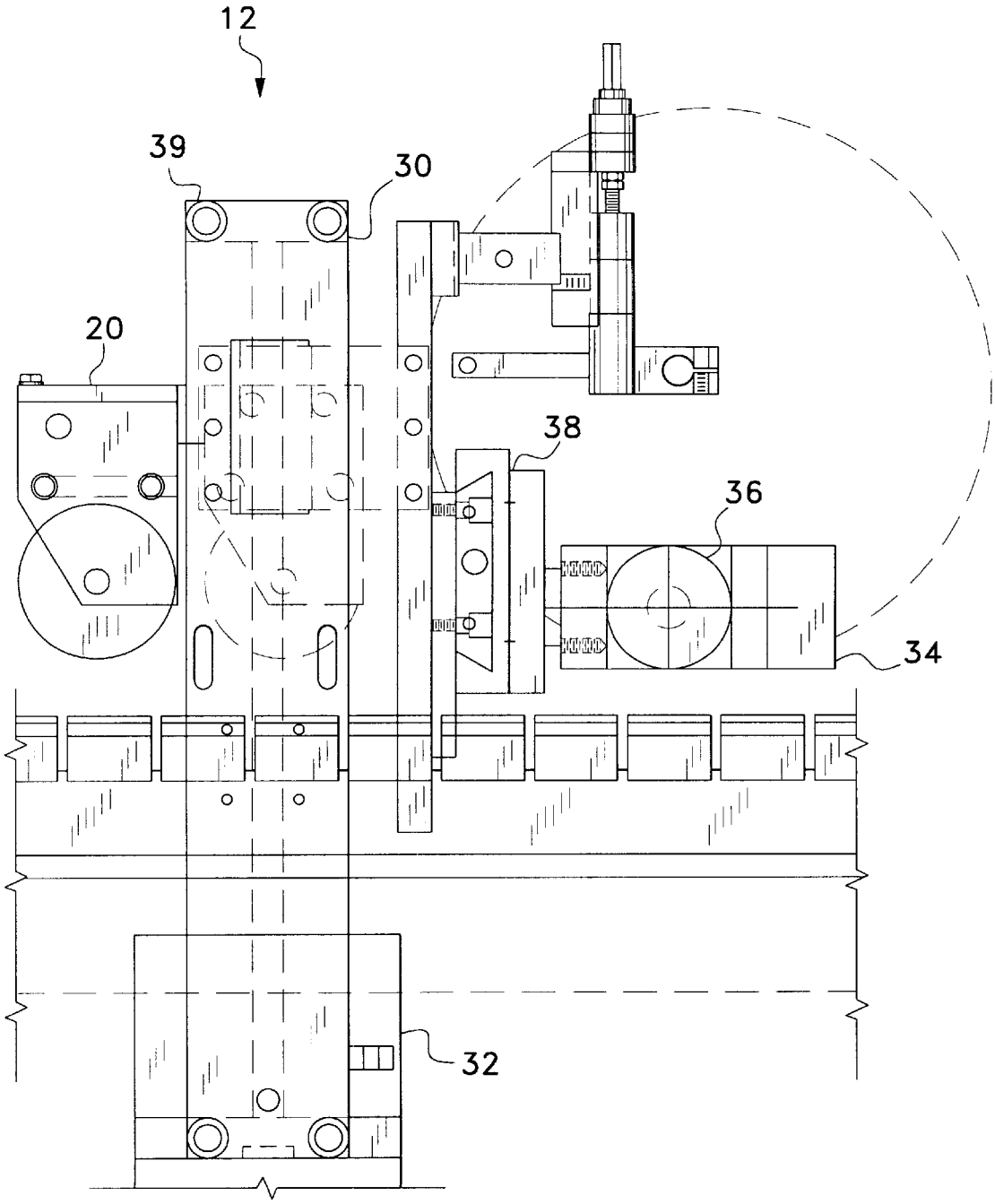
FIG. 2 is an enlarged view of the top trimmer unit of FIG. 1 according to the present invention.

Attention is now directed to FIG. 2 which shows an enlarged view of the router unit 12. Router unit 12 includes a main support structure 30 secured to a mounting bracket 32 such that router unit 12 is positioned at the entrance end of conveyor belt 16. A motor 34 which drives a shaft-mounted trimmer head 36 is attached to support structure 30 via plate structure 38. The motor 34 and trimmer head 36 are conventional and well known in the router art. Motor 34 and trimmer head 36 are attached to plate structure 38 in a manner which allows the motor and trimmer head to freely oscillate in a vertical plane. A blade spring 39 is disposed on support 30. Blade spring 39 will allow the motor and trimmer head to freely oscillate in a horizontal plane. Moving freely in both horizontal and vertical planes allows the trimmer head to follow the contours of the wood strips, thereby preventing gouging and uneven patterns.

Figure 3:
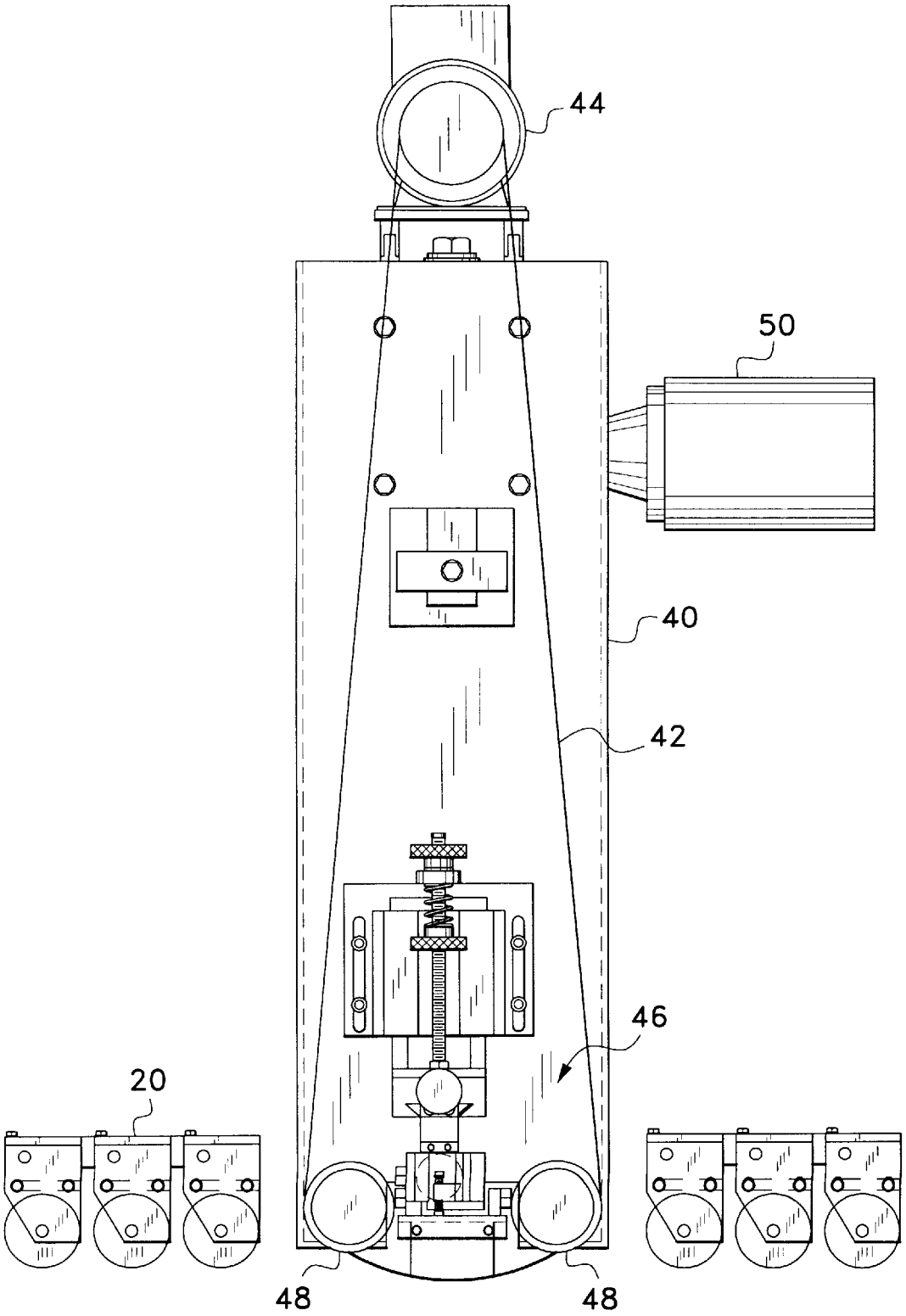
FIG. 3 is an enlarged view of a sanding unit of FIG. 1 according to the present invention.

An enlarged view of a sanding unit 14 is illustrated in FIG. 3. A casing 40 encloses an endless sandpaper belt 42 therein. A drive motor-pulley assembly 44 is positioned and attached at the top of casing 40 and is operative to provide motive force for sandpaper belt 42. A sandpaper blockholder assembly 46 is attached to the lower end of casing 40. Blockholder assembly 46 includes idler pulleys 48. Sandpaper belt 42 extends around and is in contact with motor-pulley assembly 44 and idler pulleys 48. Blockholder assembly 46 is attached to casing 40 in a manner that allows assembly 46 to freely oscillate in both vertical ant horizontal planes. An oscillating drive motor 50 functions to oscillate the sandpaper belt 42. Like the trimmer head, the freely oscillating block assembly will allow the sandpaper to move with the contours of the wood strip, thereby enabling the wood strip to be sanded to a uniform thickness in spite of uneven surfaces on the wood strips.

It is to be understood that the present invention is not limited to the embodiment described above, but encompasses any and all embodiments within the scope of the following claims.

We claim:

1. A multipurpose woodworking machine for processing wood strips having uneven contours, said woodworking machine comprising:

a frame;

a conveyor system supported on said frame, said conveyor system having a top surface for supporting and moving said wood strips;

a router unit, said router unit mounted to said frame and positioned adjacent an upstream end of said conveyor system;

a trimmer head mounted on said router unit, said trimmer head disposed above said top surface of said conveyor system for cutting said wood strips;

a sanding unit, said sanding unit mounted above said frame and positioned downstream of said router unit;

a sanding head mounted on said sanding unit, said sanding head disposed above said top surface of said conveyor system for sanding said wood strips;

first means mounting said trimmer head for oscillatory movement; and second means mounting said sanding head for oscillatory movement.

2. The invention as defined in claim 1, wherein said first means mounts said trimmer head for oscillatory movement responsive to the contours in the wood strips.

3. The invention as defined in claim 2, wherein said first means mounts said trimmer head for oscillatory movement in both horizontal and vertical planes.

4. The invention as defined in claim 1 wherein said second means mounts said sanding head for oscillatory movement responsive to the contours in the wood strips.

5. The invention as defined in claim 4, wherein said second means mounts said sanding head for oscillatory movement in both horizontal and vertical planes.

6. The invention as defined in claim 5, wherein a plurality of sanding units are positioned downstream of said router unit.

7. The invention as defined in claim 6, wherein each unit of said plurality of sanding unit comprises;

a casing, said casing having a top end and a bottom end;

said sanding head positioned within said casing adjacent said bottom end;

a pair of idler pulleys disposed on said sanding head;

a drive motor-pulley assembly positioned at said top end of said casing; and a sand paper belt extending around said drive motor-pulley and said pair of idler pulleys.

8. The invention as defined in claim 7, including means mounted on said casing for oscillating said sandpaper belt.

* * * * *